United States Patent [19]

Olesen

[11] Patent Number: 4,516,369

[45] Date of Patent: May 14, 1985

[54] TRANSPARENT PANEL FOR CURVED WALLS IN REVOLVING DOORS

[76] Inventor: Jørgen E. Olesen, Brams Sidevej 2A, 2920 Charlottenlund, Denmark

[21] Appl. No.: 608,535

[22] Filed: May 9, 1984

Related U.S. Application Data

[63] Continuation of Ser. No. 316,520, Oct. 29, 1981, abandoned.

[51] Int. Cl.[3] ..... F06B 3/90

[52] U.S. Cl. ..... 52/204; 52/245; 52/306; 49/42

[58] Field of Search ..... 52/309.13, 306, 307, 52/308, 384, 245, 204; 49/34, 404, 42–48

[56] References Cited

U.S. PATENT DOCUMENTS

| | | | |
|---|---|---|---|
| 2,112,241 | 3/1938 | Hyde | 52/306 |
| 2,294,792 | 9/1942 | Miller | 20/16 |
| 2,352,420 | 6/1944 | Winters | 460/231 |
| 2,619,167 | 11/1952 | Eckel | 49/34 |
| 3,319,392 | 5/1967 | Fitzgerald | 52/309.13 |
| 3,736,701 | 6/1973 | Rush | 49/44 |
| 3,750,338 | 8/1973 | Lissarrague | 49/458 |
| 4,341,165 | 7/1982 | Calandritti | 49/42 |

FOREIGN PATENT DOCUMENTS

| | | |
|---|---|---|
| 2901371 | 7/1980 | Fed. Rep. of Germany . |
| 1193013 | 10/1959 | France . |
| 2339730 | 1/1973 | France . |
| 2146410 | 3/1973 | France . |
| 2052612 | 1/1981 | United Kingdom . |

*Primary Examiner*—John E. Murtagh
*Assistant Examiner*—Kathryn Ford
*Attorney, Agent, or Firm*—Burgess, Ryan & Wayne

[57] ABSTRACT

A side wall panel for a revolving door, consisting of a number of high and narrow strips of flat glass, interconnected by flexible joints and maintained in the desired arcuate configuration by a curved frame. The use of flexible joints permits the panel to be shipped flat. Internal stresses in the joints are minimized by initially manufacturing the panel on a support which is curved to an arcuate shape corresponding to that of the final installation.

5 Claims, 1 Drawing Figure

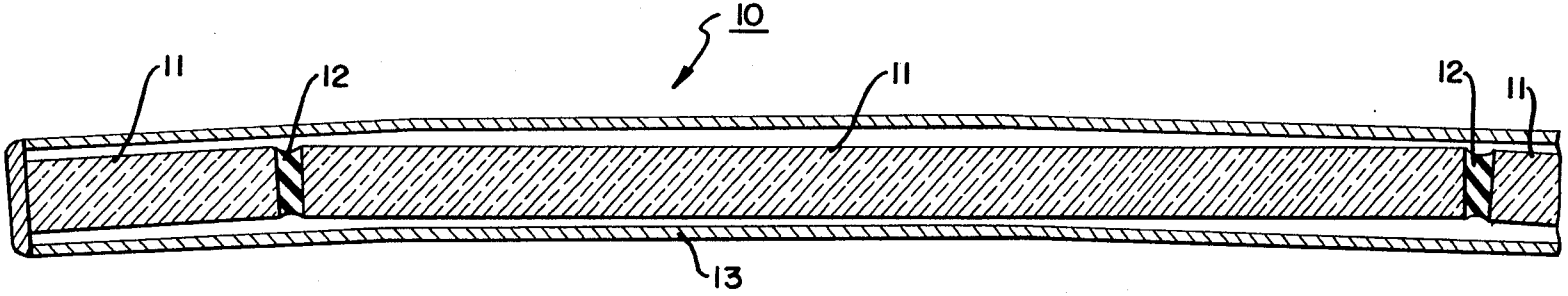
11
12
10
11
12
13
11

TRANSPARENT PANEL FOR CURVED WALLS IN REVOLVING DOORS

This application is a continuation of application Ser. No. 316,520, filed Oct. 29, 1981 now abandoned.

BACKGROUND OF THE INVENTION

This invention relates to an arcuate wall as part of a revolving door, and more particularly to arcuate side-wall members made at least partly of glass.

In order to make the entrances to buildings such as airports, hospitals, shops, administrative buildings, etc. look more attractive, it is desirable to have door leaves and the surrounding structure made from glass or with glass as a substantial part. An unimpeded or only slightly impeded look through the door construction improves traffic flow through the door by reducing the number of incidents where persons bump into one another due to lack of visibility.

The arcuate side walls in revolving doors are usually made of panels of non-transparent material such as stainless steel, or with annealed glass bent to a right cylindrical shape. A transparent plastic with sufficient scratch hardness to withstand the effect of the constantly passing sealing element (felt or brush) on the edges of each rotating door leaf is not presently available.

The use of bent, annealed glass in a door construction results in a number of disadvantages and problems.

The costs of manufacturing are high for bent glass in dimensions to be used and manufactured in the relatively small number of pieces in question with the accuracy required. The high cost of the mold for bending further tends to limit the number of door diameters available, thus limiting the architectural freedom in designing an entrance.

A problem associated with the use of annealed glass is its tendency to break into large fragments with dangerously sharp edges. For security reasons and because of the improved strength thereof, tempered or laminated the bent glass in question has led to reluctant acceptance of the use of annealed glass, and the attendant risk of personal injury in the event of breakage. This risk may be reduced somewhat by use of an increased thickness of the glass.

Another disadvantage of using bent annealed glass is the difficult transportation and mounting of these heavy and voluminous (because of the arcuate shape) pieces of glass. The handling of the panes entails a high breakage risk, adding substantially to the final price of the product.

Earlier attempts to make use of flat pieces of glass in the curved walls in revolving doors in order to make the use of tempered and laminated glass economically feasible have failed, either because the suggested design did not permit smooth rotation of the door; the sealing between the edges of the door leaves and the arcuate wall could not be maintained throughout the passage; or because the view through the transparent area was too narrow to be attractive and/or to have any effect in improving the traffic flow through the door.

It is an object of the present invention to overcome economic and technical disadvantages and problems related to earlier designs of transparent panels for arcuate walls forming part of revolving doors.

SUMMARY

As herein described, there is provided an arcuate glass panel made of a number of relatively high, narrow strips of flat glass. Each strip of glass is sufficiently wide, and the joints between the strips are sufficiently narrow, to provide an acceptable view, and the width of each strip is sufficiently narrow to enable a smooth rotation of the central revolving door member and its door leaves, the latter having a felt, brush or other edge sealing member is continuous contact with the surface of the glass panel.

The high narrow strips of flat glass may comprises tempered or laminated glass.

In order to provide an airtight, arcuate panel without individually framing each glass strip, it is preferred that each strip of glass be glued to its neighboring strip(s) along the vertical, adjacent edges thereof.

The high, narrow strips of glass may, before the mounting thereof, be sealed or joined together by means of an elastic adhesive or sealer. By providing permanent elasticity for the seals between the glass strips, it is possible to build up a large arcuate wall panel or segment away form the mounting side, to transport this panel or segment as a flat member, and to mount this member at the construction site by bending it to the curve desired, as part of the mounting operation. This technique allows for manufacturing of the seals or joints under optimal, controlled conditions in a factory and at the same time allows for fast and therefore inexpensive mounting at the construction site.

THE DRAWING

The foregoing and other features and advantages of the present invention will become more apparent in the light of the following description and accompanying drawing, which is a top cross-sectional view of a portion of an arcuate glass panel for a side wall of a revolving door according to a preferred embodiment thereof.

DETAILED DESCRIPTION

According to a preferred embodiment of the invention, a glass panel 10 for one arcuate wall for one side of a revolving door may have a radius of 210 cm., a height of the door leaves or strips equal to 230 cm., and a non-transparent, 25 cm. high foot panel in the arcuate side wall, made and mounted in the following way.

Preferably, each strip should be at least 3 inches wide but sufficiently wide so that it subtends an angle in the horizontal plane, which is no greater than 10° as measured from the axis of rotation of the revolving door. The difference in radial distance from the axis of rotation to the center and to either edge of the strip should not exceed 5 mm. Preferably, the subtended angle should not exceed 9°, and the aforementioned difference in radial distance should not exceed 3 mm.

It has been found that the majority of the commerical available brush or felt sealing means may be used for sealing between the edges of the door leaves in a revolving door and the arcuate walls in the door according to the present invention, without compromising the sealing effect and at the same time not producing such friction as to introduce disturbing effects on the smoothness of rotation; and that such commercially available sealing means can absorb changes in distance between the axis of rotation and the curved wall of 3 to 4 mm. A few of the above-mentioned sealing means (brushes and felts) can satisfactorily absorb 5 to 6 mm. variations.

In the production plant, two identical glass panels are provided, each measuring 169×205 cm. and assembled from 10 strips of glass, each 16.5 wide×205 cm. high. Each strip of glass is laminated from 3 layers of 4 mm. thick glass and 2 layers of laminating, 0.76 mm. thick sheets of polyvinylbutyrate (PVB).

The glass strips are placed in a simple mold. The mold may be made of 4 mm. thick plywood 180×220 cm., bent to a radius of curvature of approximately 210 cm., defined by two 12 mm. wide, 15 cm. or more high beams cut out of plywood. The mold is lined with a polyethylene (PE) sheet in order to prevent the sealer from sticking to the mold. The glass strips are placed parallel to one another leaving a 4 mm. wide slot therebetween. The nine slots are then filled with a clear silicone sealer and left to cure to form flexible joints 12.

After curing of the silicon rubber, the glass panel is removed from the mold and placed in a conventional flat glass transportation box or rack. A second glass panel is now made the same way, and both elements thus manufactured are transported to the mounting site.

At the mounting site, each glass panel is taken from the transportation unit and placed in the awaiting frame 13 for bending each panel to the desired curve, and releasing the joints 12 from the stresses applied to them during transportation.

After mounting the first and the second prefabricated glass panels 10, the joints between the two panels and between each panel and the frame 13 are respectively sealed in a conventional way.

In order to ensure an acceptable view through the arcuate side wall, it is necessary that each strip the glass 11 have a minimum width of at least 12.5 cm. (5 inches) being preferred. If the glass strips are too wide, a smooth rotation of the rotating body is not possible, or the necessary tight seal between the arcuate wall and the edges of the door leaves will be absent through part of the passage of the door.

In a revolving door with a diameter of 2000 mm., the maximum acceptable width of the glass strips in the panels according to the invention is 17.5 cm., a width not exceeding 15.5 cm. being preferred. In a (motorized) revolving door having a diameter of 4.80 meters, the maximum acceptable width of the glass strips in the panels according to the invention is 310 mm., and the preferred width is 240 mm. or less.

Several modifications may be introduced in relation to the above-described, preferred embodiment of the invention without departing from the idea and scope thereof, as expressed in the appended claims.

For instance, it is possible to use tempered or even annealed glass instead of laminated glass. It is possible to have the long edges of the glass strips ground to accurate shape for fitting in the frame, and the glass mounted to the frame without sealer or with a rigid adhesive; or the sealing of the joints between adjacent strips may be carried out at the mounting site. Sealing of the panels with the strips of glass placed in one plane, leaving the seals unstressed during transportation and stressed when mounted, is another possible modification.

I claim:

1. An approximately arcuate wall partially enclosing a revolving door comprising:

a plurality of high, narrow, generally rectangular strips of flat glass panes forming a transparent panel, each strip having a height corresponding to the height of said wall and a width of at least 3 inches, each strip subtending an angle not greater than 10 degrees as measured from the axis of rotation of said door, the difference in radial distance from said axis to the center and either edge of said strip not exceeding 5 mm;

joints of a flexible sealer connecting longitudinal edges of adjacent ones of said strips; and an arcuate frame enclosing said panel of said plurality of high, narrow, generally rectangular strips of flat glass panes jointed by said joints for bending said panel to a desired arcuate configuration.

2. A wall according to claim 1, wherein the minimum width of each strip is five inches, said angle is not greater than 9°, and said difference in radial distance does not exceed 3 mm.

3. A wall according to claim 1, wherein said strips comprise tempered or laminated glass.

4. A wall according to claims 1, 2 or 3, wherein said joints are airtight.

5. A wall according to claim 4, wherein said joints are resilient.

* * * * *